US011180928B2

(12) United States Patent
Mayer, Jr.

(10) Patent No.: US 11,180,928 B2
(45) **Date of Patent: *Nov. 23, 2021**

(54) MODULAR PERIMETER FENCING SYSTEM

(71) Applicant: Alabama Metal Industries Corporation, Birmingham, AL (US)

(72) Inventor: Frederic C. Mayer, Jr., Hoover, AL (US)

(73) Assignee: Alabama Metal Industries Corporation, Birmingham, AL (US)

( * ) Notice: Subject to any disclaimer, the term of this patent is extended or adjusted under 35 U.S.C. 154(b) by 35 days.

This patent is subject to a terminal disclaimer.

(21) Appl. No.: 16/743,483

(22) Filed: Jan. 15, 2020

(65) Prior Publication Data

US 2020/0149309 A1 May 14, 2020

Related U.S. Application Data

(63) Continuation of application No. 15/253,509, filed on Aug. 31, 2016, now Pat. No. 10,570,640.

(51) Int. Cl.
*E04H 17/06* (2006.01)
*E04H 17/16* (2006.01)

(52) U.S. Cl.
CPC ..... *E04H 17/06* (2013.01); *E04H 17/161* (2013.01)

(58) Field of Classification Search
CPC ..... E04H 17/06; E04H 17/08; E04H 17/10; E04H 17/12; E04H 17/124;
(Continued)

(56) References Cited

U.S. PATENT DOCUMENTS 2,856,215 A 10/1958 Schlosser
3,022,044 A 2/1962 Gugino
(Continued)

FOREIGN PATENT DOCUMENTS

DE 3311088 A1 9/1984
DE 3925052 C2 10/1991
WO WO-2014057278 A1 * 4/2014 ..... E04H 17/161

OTHER PUBLICATIONS

"WireWorks Anti-Climb." Ameristarfence, Apr. 16, 2013.http://sweets.construction.com/swts_content_files/1766/571005.pdf. Date Accessed: Apr. 18, 2019(Year: 2013).
(Continued)

*Primary Examiner* — Josh Skroupa
(74) *Attorney, Agent, or Firm* — Honigman, LLP

(57) ABSTRACT

A system and method of installing a modular fencing system in which slotted posts are used in conjunction with hollow longitudinal rails to support the fence panels in a manner that creates a unified curtain wall perimeter barrier. The posts, rails, and fence panels are made of metal. Plastic sleeves with angularly-tilted ends are inserted into both sides of a slot opening to prevent water intrusion and to facilitate fencing on a slope. The rails are then slidably inserted into and through the sleeves to be held in place through the slots. Adjacent rails are mechanically fastened to each other. The full length of the fence is bolted to the rails to ensure that any load or impact to the fence is distributed throughout the entire system. For additional strength, each fence panel is also through-bolted to metallic finish plates, which are mounted on the slotted posts.

21 Claims, 5 Drawing Sheets

(58) Field of Classification Search
CPC ..... E04H 17/1421; E04H 17/1452; E04H 17/1456; E04H 17/1465; E04H 17/1488; E04H 17/16; E04H 17/161; E04H 17/163; E04H 17/165; E04H 17/166; E04H 17/24; E04H 2017/1452; E04H 2017/1456; E04H 2017/1465
USPC ..... 256/21, 31, 35, 54, 55, 65.04, 65.05, 256/65.06, 65.11, 65.12
See application file for complete search history.

(56) References Cited

U.S. PATENT DOCUMENTS

| | | | | |
|---|---|---|---|---|
| 3,468,430 | A | 9/1969 | Lawman | |
| 3,734,467 | A | 5/1973 | Weeden | |
| 3,902,703 | A | 9/1975 | Bouye | |
| 3,955,801 | A | 5/1976 | Soriero, Jr. | |
| 4,140,298 | A | 2/1979 | Coleman, Jr. | |
| 4,542,885 | A | 9/1985 | Rossiter | |
| 4,609,185 | A | 9/1986 | Prater | |
| 4,899,991 | A | 2/1990 | Brunkan | |
| 5,161,783 | A * | 11/1992 | German | E04H 17/1413 256/65.12 |
| 5,421,557 | A * | 6/1995 | Vise | E04H 17/161 256/21 |
| 5,556,080 | A * | 9/1996 | Vise | E04H 17/161 256/21 |
| 6,290,213 | B1 | 9/2001 | Laird | |
| 6,386,519 | B1 | 5/2002 | Priefert | |
| 6,499,725 | B2 | 12/2002 | Meis | |
| 6,802,496 | B1 | 10/2004 | Preta | |
| 6,905,109 | B2 | 6/2005 | Mills | |
| 7,232,114 | B2 * | 6/2007 | Platt | E04H 17/1413 256/65.04 |
| 7,789,376 | B2 * | 9/2010 | Diamond | E04H 17/161 256/54 |
| 8,631,551 | B1 | 1/2014 | Payne | |
| 8,777,186 | B2 | 7/2014 | Russier | |
| 8,910,925 | B2 | 12/2014 | Payne | |
| 9,234,367 | B2 | 1/2016 | Kopp | |
| 9,347,191 | B2 | 5/2016 | Kemper | |
| 10,221,586 | B2 | 3/2019 | Mayer, Jr. | |
| 10,364,589 | B2 * | 7/2019 | Cochrane | E04H 17/161 |
| 10,570,640 | B2 | 2/2020 | Mayer, Jr. | |
| 10,604,962 | B1 * | 3/2020 | Givens | E04H 17/161 |
| 2004/0188667 | A1 | 9/2004 | Ray | |
| 2005/0087733 | A1 | 4/2005 | Weitzel | |
| 2006/0175590 | A1 | 8/2006 | Fumagalli | |
| 2006/0226406 | A1 * | 10/2006 | Vise | E04H 17/24 256/19 |
| 2007/0272909 | A1 | 11/2007 | Payne | |
| 2009/0321701 | A1 | 12/2009 | Payne | |
| 2010/0193756 | A1 * | 8/2010 | Buckley | E04H 17/1413 256/65.04 |
| 2010/0288989 | A1 | 11/2010 | Williams | |
| 2010/0288992 | A1 | 11/2010 | Gray | |
| 2011/0062404 | A1 | 3/2011 | Shepherd | |
| 2012/0138758 | A1 | 6/2012 | Graber | |
| 2012/0235105 | A1 | 9/2012 | Yasher | |
| 2013/0341580 | A1 * | 12/2013 | Bergner | E04H 17/16 256/24 |
| 2014/0353564 | A1 * | 12/2014 | Shepherd | E04H 17/161 256/24 |
| 2015/0041742 | A1 * | 2/2015 | Xu | E04H 17/161 256/24 |
| 2016/0097217 | A1 | 4/2016 | Loehr | |
| 2016/0108640 | A1 | 4/2016 | Graber | |
| 2017/0096835 | A1 * | 4/2017 | Messelis | E04H 17/161 |
| 2017/0321448 | A1 * | 11/2017 | Shepherd | E04H 17/161 |

OTHER PUBLICATIONS

"Niles Security Clips Block the Bad Guys." Niles Fence & Security, Jan. 13, 2015, Niles Fence & Security Products, LLC., www.nilesfence.com/blog/new-niles-security-clips-block-the-bad-guys/. Date accessed: Jun. 7, 2019. (Year: 2015).

* cited by examiner

MODULAR PERIMETER FENCING SYSTEM

TECHNICAL FIELD

The present disclosure generally relates to perimeter security systems. More particularly, and not by way of limitation, particular embodiments of the present disclosure are directed to a modular and versatile fencing system based on slotted posts with sliding rails for ease of installation and efficient load distribution.

BACKGROUND

A fence is a structure that encloses an area, typically outdoors. There are many perimeter fencing solutions available in the market. Generally, a fence around a property or area involves installing in the ground a number of posts spaced apart to receive individual connecting rails and fence panels/wires. A fence differs from a wall in that the fence typically does not have a solid foundation along its whole length.

SUMMARY

Current fencing solutions often offer round posts, which are not aesthetically pleasing because posts are integral to a fence system and should integrate with the design instead of sticking out. Furthermore, connecting rails to round posts frequently involves cutting longer lengths of rail pipe and then using clamps to secure the rail at its both ends. Clamping fittings to the post to make mechanical connection of the rails is not aesthetic and is time-consuming. Also, if the post has a hole punched through, water can invade, causing rust or freezing and splitting of the post. The rails may also be scuffed up to the point the powder coated finish of the rails is compromised. Additionally, with larger diameter posts, rails joining at posts are not on the same plane as the face of the framework. This can create a wavy appearance looking down the fence line.

The round posts in traditional fences also pose a problem as to how to give a finished look to line, corner, end, and gate posts. Lack of proper finishing may expose corners and ends of fence lines with spaces for one to begin cutting or climbing.

The individual pieces of rails used for connecting the round posts can reduce the overall strength of the fence against impact. When unwanted breaching occurs, the top rail can become bent, which may compromise the strength of the fence. Furthermore, rails that use sleeves to connect pieces of the rail can physically shift or be forced apart. This not only creates a bad visual appearance, but also reduces the level of security of the barrier.

In addition, the use of washers for fittings or clamping in conventional fences requires a large quantity of washers and does not ensure that the strength is continuous throughout the quantity of washers required.

Still further, the round posts and segmented rails in a traditional fence make it difficult to incorporate impact cables or run electric and optic cables throughout the length of the fence. It is also difficult to incorporate detection devices—such as cameras or monitoring systems—into a traditional fence design.

It is therefore desirable to address the above-mentioned problems of existing fencing systems so that a more robust and secure perimeter fencing may be accomplished. As a solution, particular embodiments of the present disclosure provide for an improved perimeter security system based on a unitized and modular construction method that ties the entire fencing system together and anchors it to the ground through slotted posts. Instead of round posts in existing fence designs, the slotted posts as per teachings of the present disclosure may be square, circular, semi-circular or rectangular. Longitudinal hollow rails are slidably inserted into and through the slots in the posts to provide a continuous rail design that eliminates many of the cuts, clamps, and connections which are necessary when installing most traditional fences. A non-metallic two-part sleeve, which may be made of plastic by way of example, is slidably inserted into the post slots to provide a water resistant, smooth surface to slide the rail through. The full length of the fence is bolted together using the hollow rails, which also allow for incorporation of impact cables as well as electrical and optic cables into the fence system. Additional improvements present in a fencing system as per particular embodiments of the present disclosure are discussed in more detail later below.

In one embodiment, the present disclosure is directed to a fencing assembly that comprises: (i) at least one slotted post to be anchored to the ground; and (ii) at least one hollow rail member to be inserted into and through a corresponding slot in the slotted post. In the fencing assembly, the slotted post includes at least one slot along the length thereof, and the rail member includes a plurality of pre-formed holes. Infill panels of the fence are to be bolted to the rail member through the plurality of pre-formed holes. In one embodiment, the slotted post and the rail member are made of metal. In another embodiment, the rail member may be made of a non-conductive material such as, for example, pultruded reinforced plastic.

As mentioned before, in particular embodiments, the slotted post may be square, circular, semi-circular or rectangular. Furthermore, the hollow rail member may also be substantially square, circular, semi-circular or rectangular in cross-section.

The fencing assembly may further comprise at least one pair of hollow sleeves, wherein each sleeve in a pair of sleeves is to be slidably placed into a respective side of the corresponding slot, and wherein the rail member is to be slidably inserted into the corresponding slot through the pair of sleeves. In one embodiment, the sleeves are made of plastic, such as nylon. The term plastic may include many different materials, but is intended to denote a non-metal material. In another embodiment, each sleeve in the pair of sleeves has a slot-facing end that is angularly tilted to allow for non-horizontal placement of the rail member through the slotted post. The angular tilt may be approximately 20°.

The fencing assembly may further comprise a finish plate to be placed over the slotted post and having a plurality of pre-drilled holes for attaching the finish plate to the slotted post. The finish plate may be made of metal. The finish plate may be directly bolted to a fence panel.

In one embodiment, the present disclosure is directed to a fencing system, which comprises: (i) a pair of slotted posts anchored to the ground and physically spaced apart, wherein each slotted post includes a respective slot along the length thereof; (ii) a hollow rail member inserted into and through a corresponding slot in each slotted post and held in position between the pair of slotted posts; and (iii) a fence panel bolted to the rail member that is inserted into the slotted posts. Throughout the length of the fence, however, it may be necessary at some point to mechanically fasten one rail to the another.

The fencing system may further comprise two pairs of plastic hollow sleeves, wherein each sleeve in a pair of sleeves is placed into a respective side of the corresponding slot sandwiched between the rail member and an internal surface of the corresponding slot. The plastic sleeves allow for slidable insertion of the rail member.

In particular embodiments, finish plates may be mounted on the slotted posts and directly bolted to a portion of the fence panel adjacent to the respective slotted post. The term "finish plate" and "metal plate" are equivalent and interchangeable.

In another embodiment, the present disclosure is directed to a method of installing a fence. The method comprises: (i) anchoring a pair of slotted posts to the ground with a pre-determined distance therebetween, wherein each slotted post includes a respective slot along the length thereof, and wherein each slotted post may be square, circular, semi-circular or rectangular in cross-section; (ii) inserting a slot-specific pair of hollow sleeves in the respective slot of each slotted post, wherein each sleeve in the slot-specific pair of sleeves is snapped into a corresponding side of the respective slot; (iii) inserting a hollow rail member into and through the sleeves in the respective slot in each slotted post, thereby holding the rail member in position between the pair of slotted posts, wherein the rail member includes a plurality of pre-formed holes; and (iv) bolting a fence panel to the rail member through the plurality of pre-formed holes.

Thus, the modular fencing system as per the teachings of the present disclosure provides for a unified curtain wall perimeter barrier. The slotted post- and slidable rail-based approach offers aesthetics, seamless design, ease of installation, and also allows incorporation of impact and electrical/optic cables in the fence system. When fence panels are bolted to the rails, any load or impact to the fence is distributed throughout the entire system, thereby greatly enhancing the strength of the system. Many different types of infill may be used for fence panel sections including, for example, anti-cut and anti-climb mesh options. Diamond Fasteners™ and finish plates provide additional strength to the fencing system. The term Diamond Fastener™ is intended to refer to the metal fastener used to bolt the fencing system.

BRIEF DESCRIPTION OF THE DRAWINGS

In the following section, the present disclosure will be described with reference to exemplary embodiments illustrated in the figures, in which.

DETAILED DESCRIPTION

In the following detailed description, numerous specific details are set forth in order to provide a thorough understanding of the disclosure. However, it will be understood by those skilled in the art that the present disclosure may be practiced without these specific details. In other instances, well-known methods, procedures, components and layouts have not been described in detail so as not to obscure the present disclosure.

Reference throughout this specification to "one embodiment" or "an embodiment" means that a particular feature, structure, or characteristic described in connection with the embodiment is included in at least one embodiment of the present disclosure. Thus, the appearances of the phrases "in one embodiment" or "in an embodiment" or "according to one embodiment" (or other phrases having similar import) in various places throughout this specification are not necessarily all referring to the same embodiment. Furthermore, the particular features, structures, or characteristics may be combined in any suitable manner in one or more embodiments. Also, depending on the context of discussion herein, a singular term may include its plural forms and a plural term may include its singular form. Similarly, a hyphenated term may be occasionally interchangeably used with its non-hyphenated version, and a capitalized entry may be interchangeably used with its non-capitalized version. Such occasional interchangeable uses shall not be considered inconsistent with each other.

It is noted that various figures (including component diagrams) shown and discussed herein are for illustrative purpose only, and are not drawn to scale.

Figure 1:
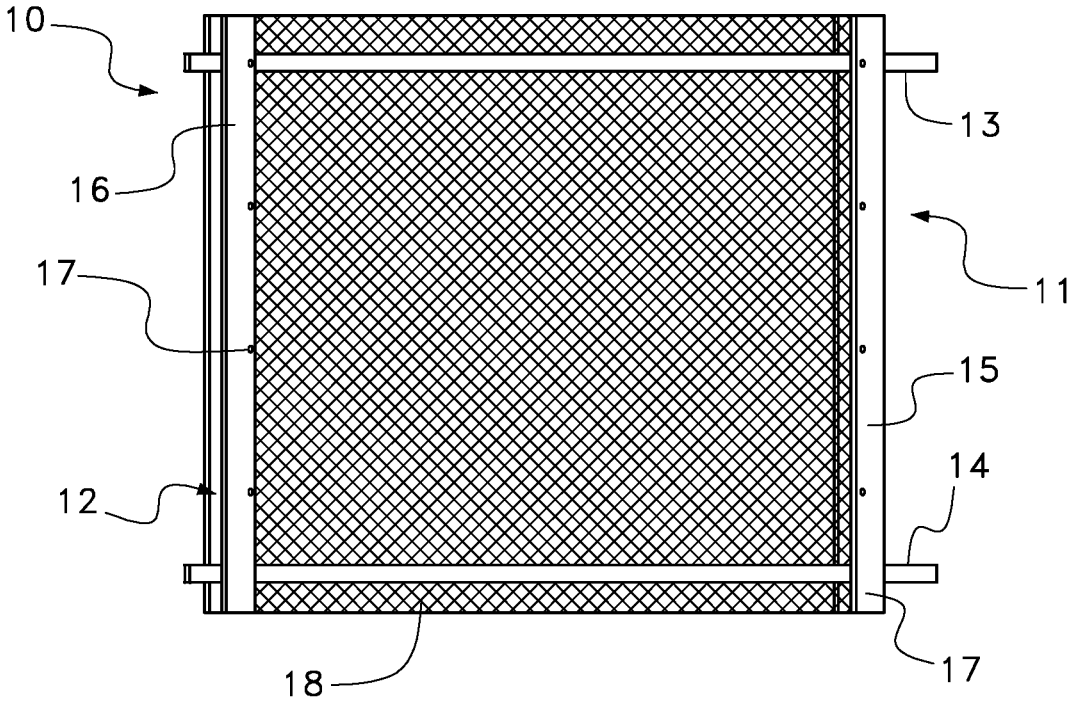
FIG. 1 shows an exemplary fence system according to one embodiment of the present disclosure.

FIG. 1 shows an exemplary fence system 10 according to one embodiment of the present disclosure. The fence system 10 shown in FIG. 1 may be a portion of a perimeter security system that may be erected surrounding a geographical area. As illustrated, the fence system 10 may include two slotted posts 11-12 supporting two longitudinal rail members 13-14, which are inserted into corresponding slots (not shown) in each slotted post 11-12 and held in position between the pair of slotted posts 11-12. An individual rail member may be held in position between the posts without a fastener. However, as mentioned before, throughout the length of the fence, it may be necessary at some point to mechanically fasten one rail to the another. For example, in certain embodiments, each rail may be 16 feet long. In that case, adjacent rails may be mechanically fastened together at every other post to create a seamless fence system. In the embodiment of FIG. 1, finish plates 15-16 are shown mounted on the respective posts 11-12 using screws 17. However, in certain other embodiments, the finish plates may be absent. The finish plate-based embodiment is discussed in more detail later with reference to FIGS. 7-8 and 10. A mesh panel or fence panel 18 may be bolted to the rail members 13-14 to provide the requisite enclosure. Because the rails 13-14 are continuous throughout a plurality of slotted posts—as opposed to appearing as individual segments and being clamped to a round post, as is the case with traditional fencing—and because the full length of the fence is bolted to the rail members, any load or impact to the fence is distributed throughout the entire system, thereby greatly enhancing the strength of the perimeter-wide fence. In particular embodiments, additional strength is provided through bolting of the mesh panels to respective finish plates, as discussed later below. Additional constructional details of various components shown as part of the fence system 10 are provided below with reference to FIGS. 2-6.

It is observed that the fence panel 18 may be made of any type of material, thereby allowing a user to customize the system to defend against a wide array of threats. In one embodiment, the fence 18 is made of metal, and may be configured to include anti-climb, anti-cut, and many other architectural appearances. In particular embodiments, the posts 11-12 may be spaced apart in such a manner as to accommodate a mesh panel 18 having a given dimension. For example, if the mesh panel 18 has a dimension of 8×12 ft., the posts 11-12 may be separated by 8 feet to snugly accommodate the mesh panel 18. Such larger mesh panels help to eliminate seams, unsightly hardware, and reduce installation time.

Figure 2:
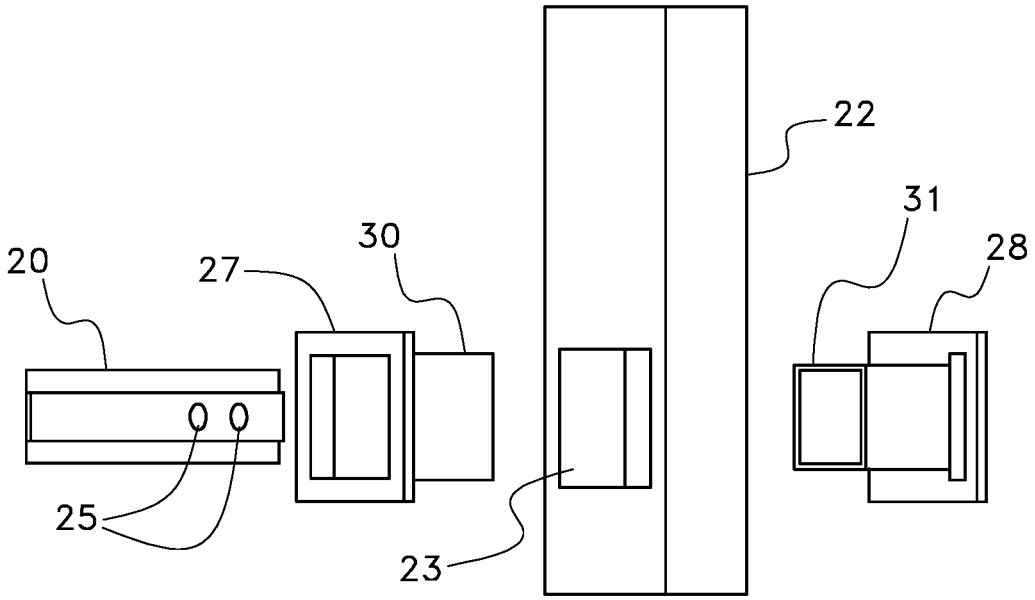
FIG. 2 provides an exemplary isometric view of how a rail member may be inserted into a slotted post as per teachings of one embodiment of the present disclosure.
Figure 5:
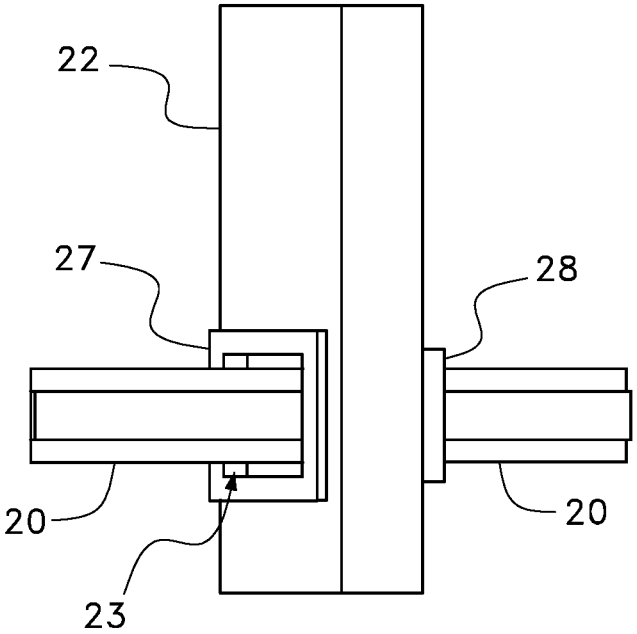
FIG. 5 illustrates an assembled view of the components shown in FIG. 2 according to one embodiment of the present disclosure.

FIG. 2 provides an exemplary isometric view of how a rail member 20 may be inserted into a slotted post 22 as per teachings of one embodiment of the present disclosure. The rail member 20 is representative of the rail members 13-14 in FIG. 1, and the slotted post 22 is representative of the slotted posts 11-12 in FIG. 1. As shown in FIG. 2, the slotted post 22 may include one or more slots—only one of which is shown in FIG. 2 and identified using the reference numeral "23." Except for the openings created by the slots—like the slot 23, the slotted post 22 may be typically a solid structure, preferably made of metal for strength, stability, and durability. On the other hand, the rail member 20 may be a hollow or partially-open structure, preferably of metal and containing a plurality of pre-formed holes 25 to facilitate bolting of a fence panel. In some embodiments, the rail member may be made of a non-conductive material such as, for example, pultruded reinforced plastic. In different embodiments, the rail members may be of different shapes, thickness, and sizes. The hollow or partially-open configuration of a rail member is more clearly shown in FIG. 8, discussed later below. The slot 23 creates an opening through which the rail member 20 may be inserted into the slotted post 22. However, in one embodiment, a pair of hollow sleeves, such as sleeves 27-28, may be slidably inserted into a respective side (left or right) of the corresponding slot, such as the slot 23, prior to inserting the rail member 20 through the slot 23. Thus, the sleeves 27-28 are sandwiched between the rail member 20 and an internal surface of the slot 23 to provide a water-resistant, smooth surface to slide the rail through. In particular embodiments, the sleeves 27-28 may be made of plastic, such as nylon, and each sleeve 27-28 may have a slot-facing end 30-31, respectively, that is angularly tilted to allow for non-horizontal placement of the rail member 20 through the slotted post 22, as discussed later below. As shown in FIG. 5, the tilted, slot-facing ends 30-31 may remain inside the slot 23 when the components shown in FIG. 2 are assembled together.

The slotted post 22 may be pre-fabricated and specifically designed to anchor the entire fence system to the ground. Unlike traditional fences, the rails, such as the rail 20 in FIG. 2, in the fence system 10 in FIG. 1 may pass directly through the post(s), thereby eliminating fittings and hardware that are potential weak points within the system. Such elimination also greatly reduces installation time and cost by eliminating fittings, clamps, washers, and other components, as well as by eliminating the need to cut the rails during installation. Because roughly one third of the entire cost of a fence can be in the installation, any time reduction can equate to substantial savings. Furthermore, the engineered and pre-determined locations for rails to pass can take into consideration the thickness of the mesh—such as the fence panel 18—and keep it on the attack side face of the framework.

In particular embodiments, the slotted post 22 may be rectangular or square in cross-section to afford better connectivity for sleeves 27-28 and rail members 20 and also to provide better aesthetics than traditional round posts. Although the rail member 20 is hollow or partially open (for example, to accommodate cables, as discussed below), it also may be substantially rectangular or square in cross-section in certain embodiments. It may also be circular or semi-circular.

As mentioned before, the continuous rail design may eliminate many of the cuts, clamps, and connections that are necessary when installing most traditional fences. In some embodiments, the rail member 20 may be roll formed and may have a highly engineered shape, making it stronger and lighter than traditional rails. The engineered and pre-punched holes 25 may allow for easy attachment of a fence panel, like the fence panel 18 in FIG. 1. On the other hand, in the traditional fences, attaching a mesh to the rails can be difficult using fittings due to the sheer number of fasteners/bolts to secure. The rail members 20 may tie the entire perimeter security system together stretching the entire length of the fence, thereby not allowing a weak joint in the fence. This may create a continuous curtain wall, greatly improving the structural integrity and ability to absorb impact. The rails 20 may create a unitized fence line, which, when impacted, may disburse the force to the adjacent posts down the line, making the fence stronger. Because of their hollow construction, the rail members 20 also may be utilized to run impact, electric, and/or fiber optic cables throughout the fence. The slots, like the slot 23, form engineered penetrations in the post 22, thereby eliminating the need to cut and bolt rails in place. Additionally, the special shape of the rail 20 may add strength for a superior support member because the rail becomes one continuous piece of metal running through the length of the fence line. With a curtain-wall design, rails 20 do not get bent, nor do they allow a leverage point to breach.

Figure 3:
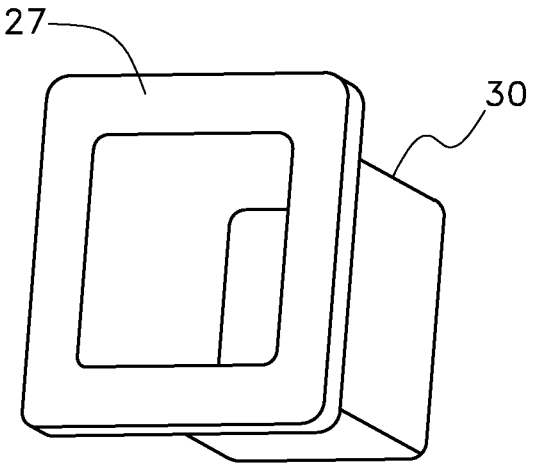
FIGS. 3 and 4 depict more-detailed isometric views of the pair of hollow sleeves shown in the exemplary embodiment of FIG. 2.
Figure 4:
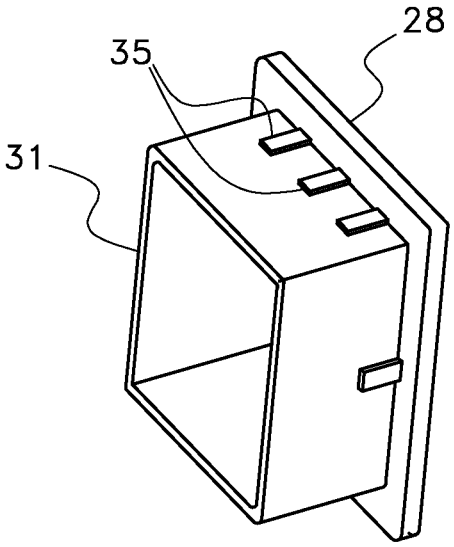

FIGS. 3 and 4 depict more-detailed isometric views of the pair of hollow sleeves 27-28, respectively, shown in the exemplary embodiment of FIG. 2. The hollow sleeves 27-28, together, may be considered as a two-part insert per slot that slides through and snaps into the respective slot 23 to provide a non-metallic, water and insect resistant, smooth surface through which the rail 20 can be slidably inserted into and through the slot 23 without scuffing. However, only one sleeve may be needed for end or gate posts. Furthermore, the sleeves may need to be mitered for corner posts. The sleeves 27-28 complement the intersection of the rail 20 and the post 22, and eliminate the need for fittings and the additional time for installation. Also, the sleeves 27-28 may protect the openings/slots in the post 22 to prevent water intrusion, which can result in corrosion and freezing and can diminish the lifespan of the fence. In particular embodiments, each sleeve 27-28 may include tabs or protrusions—such as the tabs 35 visible for the sleeve 28 in FIG. 4—to allow it to be snugly snapped into the slot 23. Additionally, in some embodiments, the angular tilt of the slot-facing ends 30-31 may allow for about a twenty degrees (20°) slope so that non-horizontal placement of the rail member 20 may be accomplished in the event the jobsite is not graded flat. Thus, the fence system as per teachings of the present disclosure can be erected on a slope as well.

FIG. 5 illustrates an assembled view of the components shown in FIG. 2 according to one embodiment of the present disclosure. As shown, the rail member 20 passes through the sleeves 27-28 inserted into slot 23 of the post 22 to provide a continuous support structure for bolting the fence panel.

Multiple rail members and slotted posts, when arranged in such a configuration, tie the entire fence together into one continuous curtain wall, greatly improving the structural integrity and ability to absorb impact or load, for example, from humans, animals, or natural elements like wind.

Figure 6:
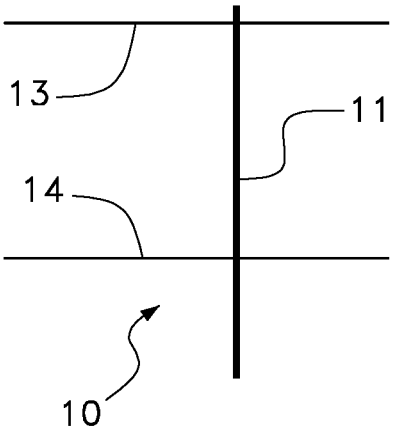
FIG. 6 is a partial configuration of the fence system in FIG. 1 showing rails inserted into a slotted post according to one embodiment of the present disclosure.

FIG. 6 is a partial configuration of the fence system 10 in FIG. 1 showing rails 13-14 inserted into a slotted post, such as the slotted post 11, according to one embodiment of the present disclosure.

FIG. 7-11 provide exemplary illustrations of various portions of a modular fence system 40 according to particular embodiments of the present disclosure. For ease of illustration, only a single post-based segment 40 is shown as the fence system in FIGS. 7-11. However, it is understood that a typical perimeter security system may include many such segments to build a fence surrounding a geographical area. Because of the earlier extensive discussion of FIGS. 1-6, only a brief discussion of the fence system 40 in FIGS. 7-11 is provided for the sake of brevity. It is understood that the slotted post and sliding rail-based construction principles discussed with reference to configurations in FIGS. 1-6 continue to apply to the embodiments in FIGS. 7-11 as well.

Figure 7:
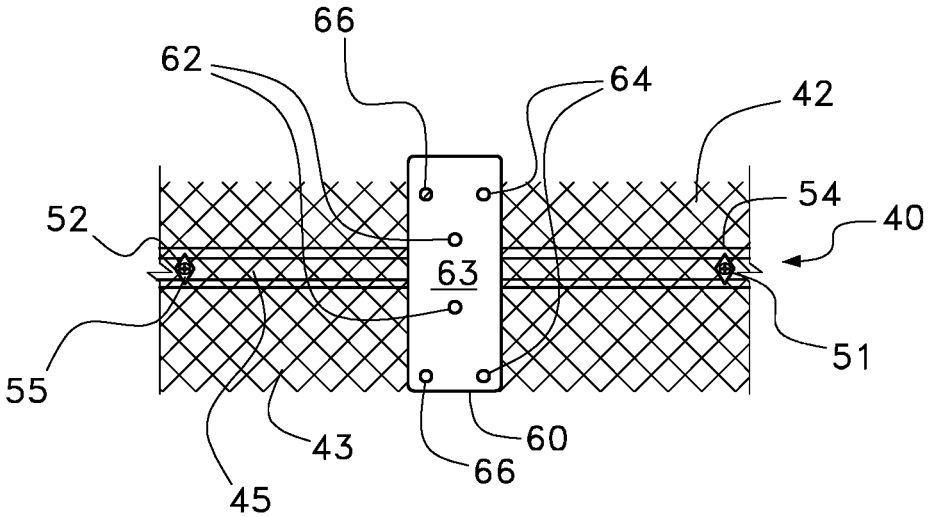
FIG. 7-11 provide exemplary illustrations of various portions of a modular fence system according to particular embodiments of the present disclosure.
Figure 8:
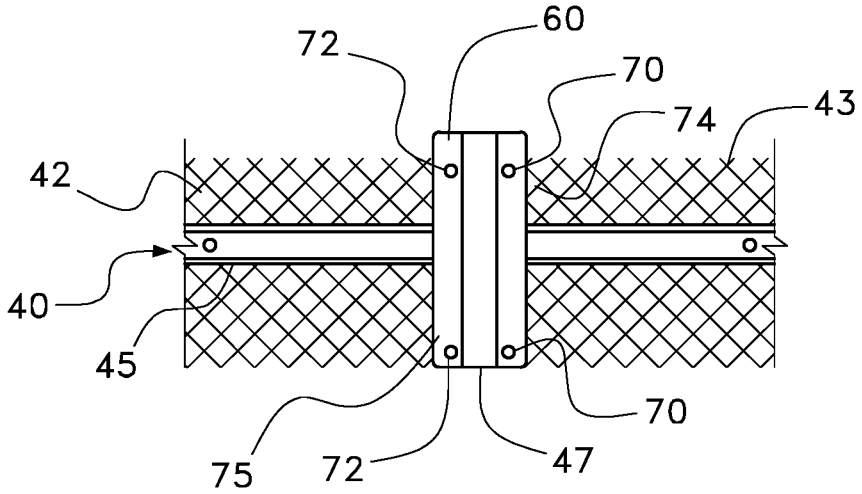
Figure 11:
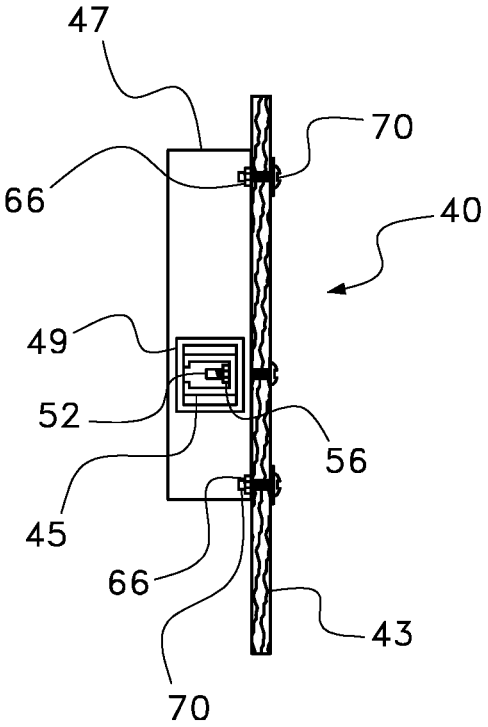

In FIGS. 7-8, two fence panels 42-43 are shown bolted to a rail member 45, which is inserted into a slotted post 47 (not visible in FIG. 7). As discussed before with reference to FIGS. 2-5, sleeves, such as sleeves 27-28, also may be inserted into the slot into which the rail member is subsequently inserted. In the illustrations of FIGS. 7-8, neither the slot nor the sleeves are visible, however one sleeve 49 is partially visible in the illustration of FIG. 11. In the embodiments of FIGS. 7-8 and 11, the rail member 45 is lengthwise hollow or partially open to accommodate different types of cables—like electric or optical fiber cables—throughout the length of the fence system, and also to allow access to the bolts to be attached to the fence panels 42-43.

In the embodiments of FIGS. 7-9 and 11, the fence panels 42-43 are shown bolted to the rail member 45 using respective attachment units or fasteners. As in case of the rail member 20 in FIG. 2, the rail member 45 also includes pre-formed holes (not shown) through which the respective fence panel may be bolted to the rail member 45. In particular embodiments, each attachment unit includes a bolt, a nut, and a metallic splice plate. For example, in FIG. 7, a bolt 51 and a metallic plate 54 are visible in connection with the fence panel 42, whereas a bolt 52 and a metallic plate 55 are visible in connection with the fence panel 43. The bolts allow the respective fence panels to be directly attached to the rail member 45, thereby providing a safe and secure attachment that is quite difficult to breach. In one embodiment, each bolt 51-52 may be a 1⅝" hot dip galvanized carriage bolt, which provides more surface area than a similarly-sized washer in conventional fences. It is noted that more surface area may provide more holding strength of the connection point. The metallic splice plates 54-55, on the other hand, may be customized in shape to match the shape of a mesh in the fence panel. These metallic plates may hide unsightly mesh intersections and mesh-to-rail joints, while providing a secure and aesthetic junction.

Figure 9:
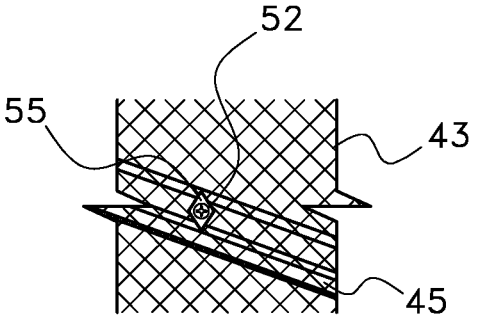

FIG. 9 shows a close-up view of the bolt 52 and metallic plate 55 attaching the fence panel 43 to the rail 45. FIG. 11, on the other hand, provides a side view of such an attachment in which a portion of the bolt 52 and associated nut 56 are visible inside the hollow rail member 45.

Referring again to the embodiment shown in FIG. 7, it is observed that a finish plate 60 may be screwed to the slotted post 47 using screws 62 to provide a seamless flow throughout the entire length of the fence. In the embodiment of FIG. 1, finish plates 15-16 are shown mounted on the respective posts 11-12 using screws 17. In particular embodiments, the finish plates may be made of metal and may conceal the respective post to create a smooth curtain wall visual that is easy on the eyes. Each finish plate—such as the finish plates 15-16 in FIG. 1 or the finish plate 60 in FIG. 7—may have a plurality of pre-drilled holes therein, allowing it to be screwed to the respective post. One such hole 63 is visible in FIG. 7. Furthermore, the pre-drilled holes also allow the finish plate 60 to be directly bolted to a portion of the fence panel adjacent to the slotted post 47. In the embodiment of FIG. 7, the finish plate 60 is shown bolted through the appropriate portion of the fence panel 42 using the bolts 64 and through the appropriate portion of the fence panel 43 using the bolts 66. Unlike clamps or bands used in traditional fences, the bolts do not visually detract from the fence and there is no loss in security either. A finish plate may allow for an engineered and strong termination of the fence panels and also may connect the entire line of fence for added strength and no place for easy breaching. In the unitized construction of a perimeter security system as per teachings of the present disclosure, the finish plates may tie together the curtain wall with the rest of the system while creating a finished, seamless, and aesthetically-pleasing look.

In FIG. 8, the fence-bolted back side of the finish plate 60 is more clearly visible. Two nuts 70 and corresponding splice plates 74 are part of the attachment units that include the respective top and bottom bolts 66 in FIG. 7. Similarly, the nuts 72 and metallic plates 75 may be associated with corresponding top and bottom bolts 64 through the fence panel 42. For ease of illustration, all splice plates are not identified with reference numerals in FIG. 8. In one embodiment, the bolts 64, 66 may be similar to the earlier-discussed bolt 52 (FIGS. 9 and 11); the nuts 70, 72 may be similar to the nut 56 (FIG. 11), and metallic plates 74-75 may be similar to the earlier-discussed metallic plate 55. Hence, additional discussion of the nut-bolt based attachment of the finish plate 60 through the respective portions of the fence panels is not provided herein. In one embodiment, the bolts 64, 66 may be ⅜"×1" hot dip galvanized carriage bolts. In certain embodiments, the bolts 64, 66 may be break-away bolts and corresponding nuts may be break-away nuts, and these break-away bolts and nuts may be used at each corner attachment point of a finish plate to bolt the finish plate to the respective fence panel so that the nut-bolt assembly cannot be removed to breach the barrier.

Figure 10:
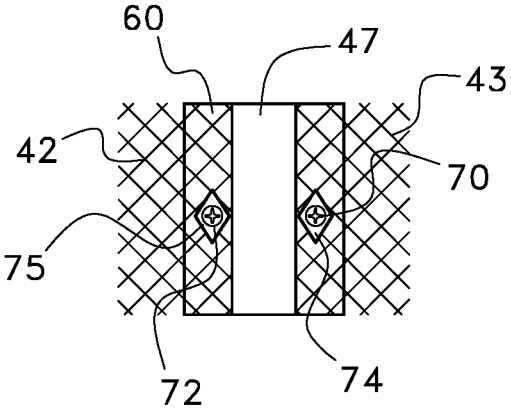

FIG. 10 provides a close-up view of a portion of the finish plate 60 along with a more detailed view of its bolting to respective fence panels 42-43. In FIG. 11, the back sides of the bolts 66 and corresponding nuts 70 are more clearly visible.

It is noted here that the square, circular, semi-circular or rectangular posts as per teachings of the present disclosure may utilize flat top caps, adding to the engineered appearance of the barrier. Furthermore, the modular approach to fence construction as per teachings of the present disclosure permits easy attachment of detection devices—such as surveillance cameras or security lights—to the flat surfaces of rectangular or square posts. Also, the posts may be easily extended to incorporate such detection devices into the fence design.

Figure 12:
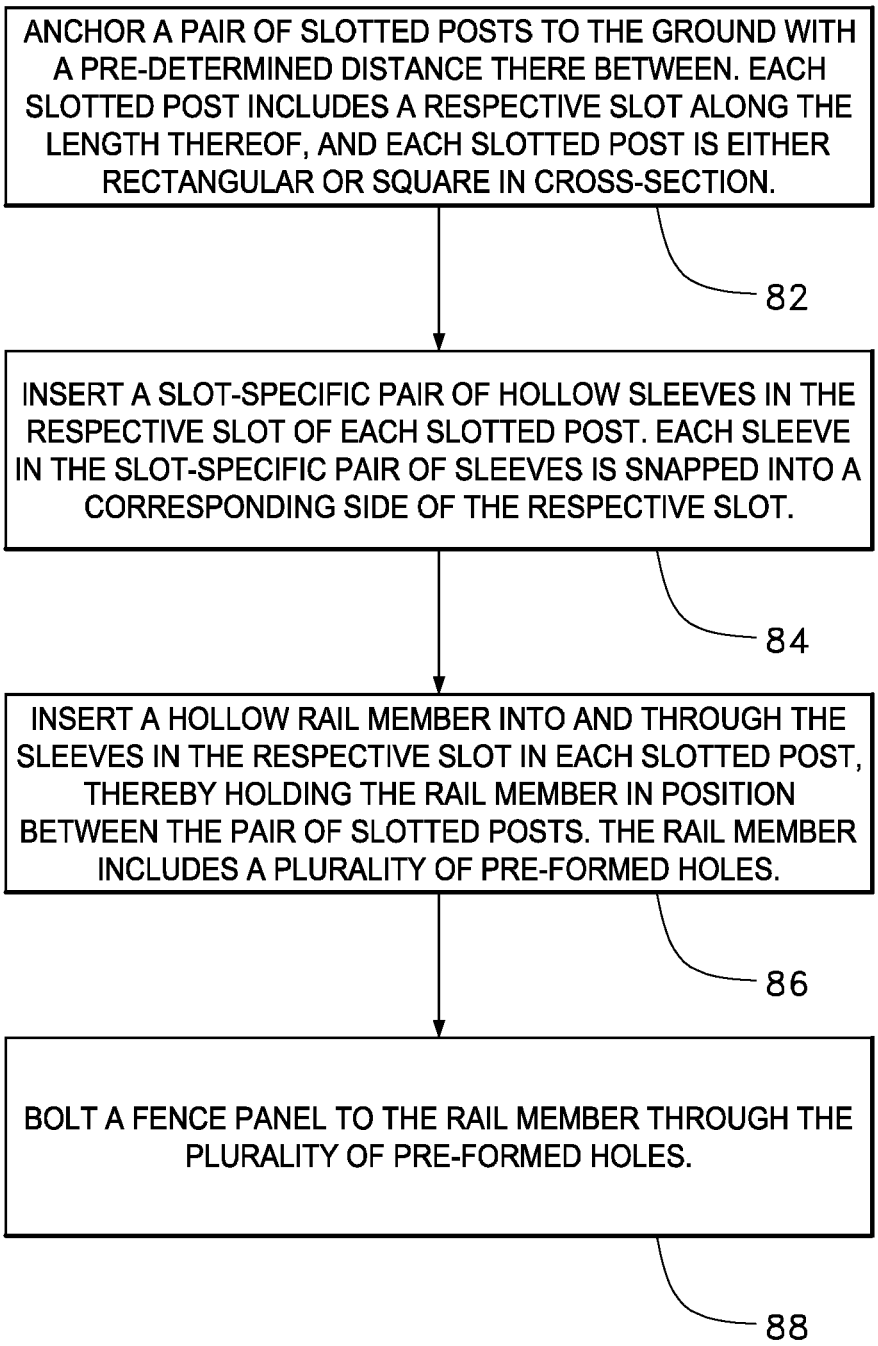
FIG. 12 is an exemplary flowchart of a fence installation method according to one embodiment of the present disclosure.

FIG. 12 is an exemplary flowchart 80 of a fence installation method according to one embodiment of the present disclosure. As noted at block 82, initially, a pair of slotted posts—like the posts 11-12 in FIG. 1—may be anchored to the ground with a pre-determined distance therebetween (to accommodate a fence panel of given dimensions). Each slotted post may be square, circular, semi-circular or rectangular in cross-section—similar to one of the slotted posts discussed before with reference to FIGS. 1-11—and may include at least one respective slot—like the slot 23 in FIG. 2—along the length thereof. As part of the anchoring step at block 82, it may be necessary to perform one or more of the following ancillary or preparatory tasks such as, for example: (i) confirming the layout of the eventual fence with appropriate utility company/companies; (ii) completing any grubbing and site preparation; (iii) staking out the layout for the fence and locating corner, end, and gate posts; (iv) digging a terminal post hole that meets the utilities specifications for size and depth; (v) marking locations for other post holes; (vi) stretching a string at a position to set the height of the posts above the grade; (vii) marking (with a marker or crayon) the posts with the depth of embedment plus the height of the string from grade, thereby allowing for the top line of the fence to be consistent; (viii) filling the post hole with concrete, tamping the post into concrete, and checking the distance from post to post; (ix) making sure that the openings in the posts are in the direction of the rails; (x) allowing a post to set at line on post matching with the string height; and (xi) surrounding the posts with concrete in a continuous pour, trowel-finishing around the posts and sloping it downward to direct water away. It is noted here that, as a general rule, the post hole size may be as per the ASTM A567 specification, where the acronym "ASTM" refers to "American Society for Testing and Materials." Thus, for example, the diameter of the post hole may be four times the diameter of the post, and the depth of the hole may be 24 inches plus 3 inches for each 1-foot increase in the height of the fence over four (4) feet. An eight (8) feet fence may generally require 36-inch embedment in concrete.

At block 84, a slot-specific pair of hollow sleeves—like the sleeves 27-28 in FIG. 2—may be inserted in the respective slot of each slotted post in the pair of posts mentioned at block 82. Each sleeve in the slot-specific pair of sleeves may be snapped into a corresponding side of the respective slot, as discussed earlier with reference to discussion of FIGS. 2-5. Thereafter, at block 86, a hollow rail member—like the rail member 45 in FIG. 7—may be inserted into and through the sleeves in the respective slot in each slotted post, thereby holding the rail member in position between the pair of slotted posts. As discussed before, the rail member may be slidably inserted. Although an individual rail member may be held in position through the slot without a fastener, adjacent rail members may be mechanically fastened to each other to create a seamless fence system. As discussed before, in particular embodiments, the rail member may include a plurality of pre-formed holes. At block 88, a fence panel—like the fence panel 42 in FIG. 7—may be bolted to the rail member through the plurality of pre-formed holes in the rail member.

More specifically, in particular embodiments, the plastic sleeves may be inserted per rail per post after the concrete footings have been allowed to sufficiently harden. The rail may be then passed through the slotted posts, connecting segments of a rail with rail connectors (not shown). As noted before, sleeves for corner posts may be mitered, and only one part of the pair of sleeves may be used for end and gate posts. In certain embodiments, ⅜"×1½" hot dip galvanized carriage bolts may be used to secure rails with rail connectors. The installation of the top and bottom rails may be completed before installing mesh panels.

In one embodiment, starting at a terminal post, a mesh/fence panel may be tilted up against the respective pair of posts and corresponding rails. Once a mesh panel is placed between two posts, it may be desirable to make sure that the direction of its design strands—such as, for example, diamond-shaped strands shown in FIGS. 7-8—always go in the same direction as those in its neighboring panel(s) so as to avoid a checker-board appearance. Due to the crew, terrain (slope), and other factors, it may be desirable to initially connect a mesh panel to the top rail with two clamps (not shown) so that the top of the fence line properly follows the grade. However, in some embodiments, the ultimate order in securing mesh panels to finish plates and connecting them to rail members may be made at the installer's discretion.

As noted before, in particular embodiments, a fence panels may be connected to the rails using 1⅝" hot dip galvanized carriage bolts and corresponding metallic plate and nut. As mentioned earlier, the panels fit in-between posts. In some embodiments, a long, round-shank screw driver may be used to gain leverage in moving fence panels up as needed to maintain the top line of the fence parallel to the grade. All nuts may be hand tightened. In particular embodiments, the outermost attachment points for mesh to rails may utilize a break-away nut to prevent easy removal and unwanted access.

Subsequently, the finish plates may be connected to the posts and mesh panels. In certain embodiments, each type of post—line, end, corner, and gate post—may receive a finish plate. As mentioned before, finish plates may be pre-drilled to assist in locating fastening points. In connecting a finish plate to a post, the top of the plate may be aligned with the top of the post and tamper proof ¼"×1" TEK® screws may be used in certain embodiments to secure the finish plate true and plumb to the post. TEK® screws drill their own hole and then tap threads to combine two or more pieces of material. This is done with nothing more than a standard power drill motor. On the other hand, in some embodiments, the finish plates may be connected to the fence panels using ⅜"×1" hot dip galvanized carriage bolts. In particular embodiments, the splice plates may be Diamond Fasteners™. Final tightening and peening or scarfing of threads may be done after all panels have been installed. As mentioned before, properly-sized post caps may be attached to each post. Also, after the fence system is erected in place, gates and operators may be installed to manufacturer's instructions.

In the preceding description, for purposes of explanation and not limitation, specific details are set forth (such as particular structures, components, techniques, etc.) in order to provide a thorough understanding of the disclosed fencing system. However, it will be apparent to those skilled in the art that the disclosed system may be constructed in other embodiments that depart from these specific details. That is, those skilled in the art will be able to devise various arrangements which, although not explicitly described or shown herein, embody the principles of the disclosed system. In some instances, detailed descriptions of well-known components and construction methods are omitted so as not to obscure the description of the disclosed system with unnecessary detail. All statements herein reciting principles, aspects, and embodiments of the disclosed system, as well as specific examples thereof, are intended to encompass both structural and functional equivalents thereof. Additionally, it is intended that such equivalents include both currently known equivalents as well as equivalents developed in the future, such as, for example, any elements developed that perform the same function, regardless of structure.

Alternative embodiments of the fencing system according to inventive aspects of the present disclosure may include additional components responsible for providing additional functionality, including any of the functionality identified above and/or any functionality necessary to support the solution as per the teachings of the present disclosure. Although features and elements are described above in particular combinations, each feature or element can be used alone without the other features and elements or in various combinations with or without other features.

The foregoing describes a modular perimeter fencing system in which metallic slotted posts are used in conjunction with metallic hollow longitudinal rails of different shapes, thickness, and sizes to support the metallic fence panels in a manner that creates a unified curtain wall perimeter barrier. Plastic sleeves with angularly-tilted ends are inserted into both sides of a slot opening to prevent water intrusion and to facilitate fencing on a slope. The rails are then slidably inserted into and through the sleeves. Thus, rails are held in place upon insertion through the slots without a fastener. The full length of the fence is bolted to the rails to ensure that any load or impact to the fence is distributed throughout the entire system. For additional strength, each fence panel is also through-bolted to metallic finish plates, which are mounted on the slotted posts for seamless and aesthetically-pleasing look.

As will be recognized by those skilled in the art, the innovative concepts described in the present application can be modified and varied over a wide range of applications. Accordingly, the scope of patented subject matter should not be limited to any of the specific exemplary teachings discussed above, but is instead defined by the following claims.

What is claimed is:

1. A fencing assembly comprising:

a slotted post substantially vertically anchored to the ground and having a slot that extends between two opposite sides of the slotted post;

a pair of hollow sleeves, wherein each hollow sleeve in the pair of hollow sleeves has an opening and is placed inside a respective side of the slot that extends between two opposite sides of the slotted post;

a hollow rail member inserted into the opening in each hollow sleeve in the pair of hollow sleeves, wherein the hollow rail member is maintained in the slot and extends out of the two opposite sides of the slotted post, wherein the hollow rail member includes a plurality of pre-formed holes and a lengthwise opening opposite the plurality of pre-formed holes, a fence bolted to the hollow rail member through at least one of the plurality of pre-formed holes;

a bolt having a head and a shaft;

a nut; and a metallic plate;

wherein the bolt secures the fence to the hollow rail member by the nut and a portion of the shaft of the bolt being inside the hollow rail member, at least a portion of the shaft goes through one of the plurality of pre-formed holes in the hollow rail member and the metallic plate is between the fence and the head of the bolt to secure the metallic plate on the shaft which secures the fence to the hollow rail member.

2. The assembly of claim 1, wherein at least one of the following applies:

the slotted post is made of either metal or a non-conductive material;

the fence is made of metal or a non-conductive material; and the rail member is made of either metal or a non-conductive material.

3. The assembly of claim 1, wherein the slotted post is either rectangular or square in cross-section.

4. The assembly of claim 3, wherein the rail member is substantially rectangular or square in cross-section.

5. The assembly of claim 1, wherein each hollow sleeve in the pair of hollow sleeves is to be slidably placed into a respective side of the corresponding slot, and wherein the rail member is to be slidably inserted into the corresponding slot through the pair of hollow sleeves.

6. The assembly of claim 5, wherein each hollow sleeve is made of plastic.

7. The assembly of claim 5, wherein each hollow sleeve in the pair of hollow sleeves has a slot-facing end that is angularly tilted to allow for non-horizontal placement of the rail member through the slotted post.

8. The assembly of claim 7, wherein the angular tilt is approximately 20°.

9. The assembly of claim 1, wherein the bolt, the nut, and the metallic plate comprises an attachment unit, and wherein the fencing assembly further comprises:

a plurality of attachment units for bolting the fence to the rail member.

10. The assembly of claim 1, further comprising:

a finish plate to be placed over the slotted post and having a plurality of pre-drilled holes for attaching the finish plate to the slotted post.

11. A fencing system comprising:

a pair of slotted posts anchored to the ground and physically spaced apart, wherein each slotted post includes a respective slot along the length thereof and wherein each post-specific slot extends between two opposite sides of the respective slotted post;

two pairs of plastic hollow sleeves, wherein each pair of hollow sleeves is associated with a corresponding slot, and wherein each hollow sleeve in a pair of hollow sleeves is placed into a respective side of the corresponding slot and has an opening;

a hollow rail member slidably inserted into the opening and through each hollow sleeve in the two pairs of hollow sleeves so as to remain inside each post-specific slot, wherein the hollow rail member is held in position between the pair of slotted posts and extends out of two opposite sides of each slotted post, and wherein the hollow rail member has a plurality of pre-formed holes and a lengthwise opening opposite the plurality of pre-formed holes;

a fence panel bolted to the hollow rail member through at least one of the plurality of pre-formed holes;

a bolt having a head and a shaft;

a nut; and a metallic plate;

wherein the bolt secures the fence panel to the hollow rail member by the nut and a portion of the shaft of the bolt being inside the hollow rail member, at least a portion of the shaft goes through one of the plurality of pre-formed holes in the hollow rail member and the metallic plate is between the fence panel and the head of the bolt to secure the metallic plate on the shaft which secures the fence panel to the hollow rail member.

12. The system of claim 11, wherein at least one of the following applies:

each slotted post is made of metal;

the rail member is made of either metal or a non-conductive material; and the fence panel is made of metal.

13. The system of claim 11, wherein each slotted post is either rectangular or square in cross-section.

14. The system of claim 11, wherein each hollow sleeve in the pair of hollow sleeves is placed into the respective side of the corresponding slot sandwiched between the rail member and an internal surface of the corresponding slot.

15. The system of claim 14, wherein each hollow sleeve has a slot-facing end that is angularly tilted and that remains inside the corresponding slot.

16. The system of claim 14, wherein the rail member includes the plurality of pre-formed holes along the length thereof, wherein the bolt, the nut, and the metallic plate comprise an attachment unit, and wherein the system further comprises:

a plurality of attachment units placed at locations of the plurality of pre-formed holes for maintaining the fence panel bolted to the rail member.

17. The system of claim 16, further comprising:

at least one finish plate having a plurality of pre-drilled holes therein, wherein the finish plate is mounted on a respective slotted post and bolted to a portion of the fence panel adjacent to the respective slotted post through the plurality of pre-drilled holes.

18. A method of installing a fence, said method comprising:

anchoring a pair of slotted posts substantially vertical to the ground with a pre-determined distance therebetween, wherein each slotted post includes a respective slot along the length thereof;

inserting a slot-specific pair of hollow sleeves in the respective slot of each slotted post, wherein each sleeve in the slot-specific pair of sleeves is snapped into a corresponding side of the respective slot;

inserting a hollow rail member into and through the sleeves in the respective slot in each slotted post, thereby holding the rail member in position between the pair of slotted posts, wherein the rail member includes a plurality of pre-formed holes;

bolting a fence panel to the rail member through the plurality of pre-formed holes; and wherein each sleeve is made of plastic, and wherein each slotted post, the rail member, and the fence panel are made of metal, and wherein each finish plate is made of metal.

19. The method of claim 18, further comprising:

mounting a respective finish plate on each slotted post; and bolting each finish plate to a portion of the fence panel adjacent to the slotted post on which the finish plate is mounted using a plurality of pre-drilled holes in the finish plate.

20. The method of claim 19, wherein at least one of the following applies:

the slotted post is made of either metal or a non-conductive material;

the fence panel is made of metal or a non-conductive material; and the rail member is made of either metal or a non-conductive material.

21. The method of claim 18, wherein the step of inserting the hollow rail member into and through the sleeves includes:

slidably inserting the hollow rail member into and through the sleeves in the respective slot in each slotted post.

* * * * *